United States Patent [19]

Jones

[11] Patent Number: 5,001,485

[45] Date of Patent: Mar. 19, 1991

[54] MAGNETIC FIELD GENERATOR

[75] Inventor: Louis F. Jones, Panama City, Fla.

[73] Assignee: The United States of America, as represented by the Secretary of the Navy, Washington, D.C.

[21] Appl. No.: 788,983

[22] Filed: Dec. 20, 1968

[51] Int. Cl.[5] ..... G01S 7/36

[52] U.S. Cl. ..... 342/13; 114/240 A

[58] Field of Search ..... 324/34, 3; 340/4, 4 E; 114/240 A; 342/13

[56] References Cited

U.S. PATENT DOCUMENTS 1,197,366 9/1916 Hahnemann ..... 340/852

3,273,110 9/1966 Monroe et al. ..... 342/367 X

FOREIGN PATENT DOCUMENTS 889356 2/1962 United Kingdom .

*Primary Examiner*—Mark Hellner

*Attorney, Agent, or Firm*—Sol Sheinbein; Harvey David; John Becker

[57] ABSTRACT

Two electrodes attached to the hull of a ship, one electrically connected thereto and one insulated therefrom, are employed to transmit, via sea water, an electrical signal. The current return of the signal passing through the ship's hull generates a magnetic field corresponding to the electrical signal. The magnetic field is effective to cause detonation of magnetically triggered naval ordnance at a range greater than the optimum range at which the ordinance would detonate in the absence of said generated magnetic field.

10 Claims, 2 Drawing Sheets

MAGNETIC FIELD GENERATOR

The invention described herein may be manufactured and used by or for the Government of the United States of America for governmental purposes without the payment of any royalties thereon or therefor.

The self propelled torpedo, together with a variety of other ordnance, constitutes a continuing threat to personnel serving their country aboard naval vessels in time of hostility. Particularly effective are those instruments having proximity fusing devices which cause the devices to explode destructively near a naval vessel without having made actual contact therewith. Foremost among these devices is a torpedo having a magnetically operated detonation mechanism. This type of torpedo is, in some instances, directed so as to pass beneath a surface ship and explode thereunder, where the hull is particularly vulnerable to explosive penetration. Similar techniques and ordnance are employed against submarine vessels, but, for purposes of brevity, only the surface ship application will be discussed herein. The corresponding underwater application is considered obvious to persons versed in the submarine warfare arts.

In the past, efforts to counter torpedoes have employed means to intercept the torpedo or to cause its destruction at a range beyond the effective range thereof. Such prior art means have been streamed from the bow of the ship to be protected, and are constructed and deployed so as to extend along side the ship. An example of this type of torpedo protection is described in U.S. Pat. No. 2,668,512. While these systems are reasonable effective, they are cumbersome to deploy and interfere with the control and maneuverability of the ship.

Another disadvantage of the prior art torpedo countermeasure systems is that their use may be detected, that is, the deployment of the devices is readily apparent from visual inspection of the ship, or from the acoustic signatures of the ship in motion. Having the information thus obtained, personnel launching the torpedo may make suitable compensating adjustments to the proximity firing mechanism to cause the torpedo to reach its intended firing point despite the countermeasure efforts being taken.

It is, therefore, an object of this invention to provide an improved torpedo countermeasure system.

It is, accordingly, an object of this invention to provide an effective torpedo countermeasure system to overcome the deficiencies of the prior art systems.

A further object of this invention is the provision of a torpedo countermeasure system which will not interfere with the maneuverability of the craft protected thereby.

Another object of this invention is the provision of a torpedo countermeasure system which does not alter the acoustic signature of the vessel employing the system.

Another object of this invention is the provision of a torpedo countermeasure system which is useable without providing visible external modification to the vessel employing the system.

Still a further object of this invention is the provision of a torpedo countermeasure system effective to cause magnetically detonated torpedoes to explode prior to approach within optimum range.

Other objects and many of the attendant advantages will be readily appreciated as the subject invention becomes better understood by reference to the following detailed description, when considered in conjunction with the accompanying drawings wherein:

FIG. 1 is an illustration of a ship, in profile, employing the invention;

FIG. 1*a* is an illustration of a subsurface vehicle employing the invention;

Figure 1:
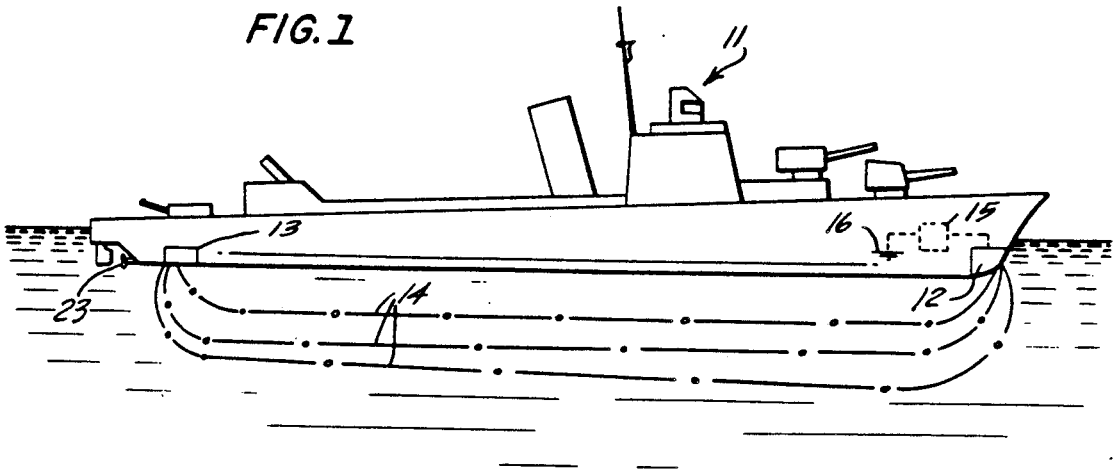

Referring to FIG. 1, a ship 11 is shown employing the system of the invention. An electrode 12 of considerable area is shown mounted below the waterline of ship 11 in the region of the bow thereof. A second electrode 13 is mounted in the aft region of the metal hull of ship 11. Like electrode 12, electrode 13 is of considerable extent and is immersed in the sea below the water line of ship 11. The foreward electrode 12 is insulated from the hull of ship 11, in a manner to be herein disclosed, and the aft electrode 13 is electrically joined to the hull of ship 11.

When ship 11 is at sea, a conduction path between electrodes 12 and 13 is established by the sea water. This conduction path is illustrated in FIG. 1 by lines 14. As shown, the conduction path extends beneath the hull of ship 11, but it should be understood that the conduction path extends to the sides of ship 11 in a similar fashion. Because of the volumetric extent of the water conduction path, the current flowing along any single line is quite small, even in cases where considerable electrical power is transmitted.

Figure 1A:
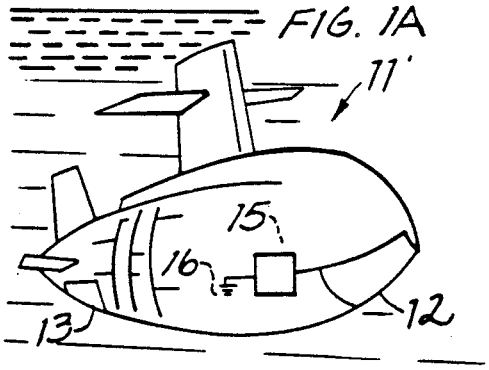

Within ship 11 is housed an electrical signal generating apparatus 15. The output thereof is connected between electrode 12 and a hull ground return 16. Due to electrode 13 being electrically connected to the metal hull of ship 11, a return path to the electrical signals generator 15 is provided by the hull structure. The hull of ship 11, although made of metal, does not act as an electrode intermediate the foreward electrode 12 and the aft electrode 13 because the insulating properties of the conventional coating of anti-corrosion marine paint thereon. Of course, small irregularities in the hull protection paint permit some minor variations in the conduction path, but such local irregularities are of insufficient magnitude and number to alter the overall pattern or electromagnetic effect of the illustrated conduction path. FIG. 1*a* shows a similar installation on a subsurface vessel 11′.

Figure 2:
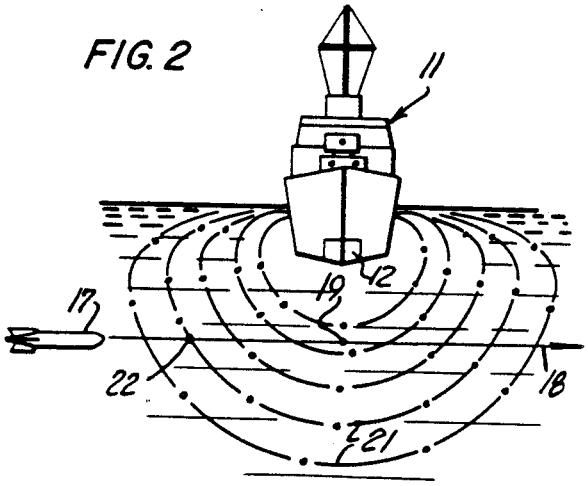
FIG. 2 is a bow-on view of the ship of FIG. 1 showing an approaching torpedo and the trajectory thereof.

Referring to the bow view of ship 11, illustrated in FIG. 2, a torpedo 17 is shown approaching ship 11 on a course indicated by an arrow 18. The magnetic proximity detonation mechanism within torpedo 17, and operatively connected thereto, will normally be set so as to detonate the device at a predetermined distance, such as at point 19 beneath the ship. As torpedo 17 approaches ship 11, it encounters the magnetic field produced by the current conduction in the water. This field is rather weak and is countered by the oppositely directed field produced by the return current flowing in the hull of ship 11. As the range to ship 11 closes, the influence of the current flowing in the hull becomes more pronounced. This field, illustrated by lines 21, causes the magnetic proximity mechanism in torpedo 17 to cause its detonation at a point 22 beyond the optimum range.

Electrode 13, as noted above, is electrically joined to the hull of ship 11, and, if desired, may be merely an unpainted section of the plating. More effective, however, are especially designed electrodes having large surface areas and anti-corrosive properties. Because such electrode structures are well known in oceanographic technical circles, and since each installation requires a somewhat different configuration to accommodate the individual hull shape, no specific construction is shown herein. In some installations, the screws 23 constitute a sufficient electrode surface, and, in those instances, electrode 13 may be dispensed with all together.

Although theoretically the relative position of the electrodes is immaterial, the placement of the hull potential electrode 13 at the aft region of the hull of ship 11 is dictated by the position of the screws 23. The surface of the screws of a naval vessel are generally either unpainted or have the paint coating broken over large areas by the corrasive action of water borne debris. The screws are electrically united to the hulls, and a change so as to electrically insulate them therefrom would constitute a major alteration of their design. The rearward placement of electrode 13 is, therefore, in the interest of expediency and economy of installation.

Figure 3:
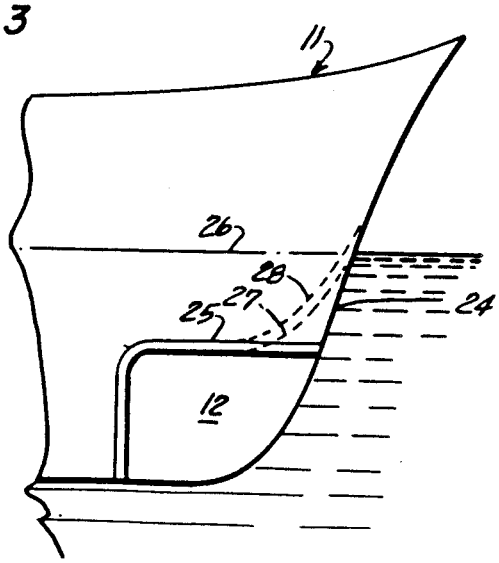
FIG. 3 is a fragmentary showing of the bow region of a ship and showing a portion of the system of the invention mounted thereon.

FIG. 3 illustrates the mounting of foreward electrode 12 on the bow 24 of ship 11. Electrode 12 conforms to the bow configuration of ship 11 and extends on either side thereof. Electrical connection is made to electrode 12 by means of insulated feedthrough connecting devices, not shown, which are attached to the back thereof and extend through the hull of ship 11. Attachment of electrode 12 to the hull of ship 11 may be by suitable mechanical means, not shown, by use of suitable adhesive materials, or by a combination of the two. Electrical insulation of electrode 12 from the hull of ship 11 is further assured by a layer 25 of insulating cementious material, termed ploc, which extends beyond the edge of electrode 12. Because the bow 24 is particularly subject to the corrasive action of the water and water carried debris, electrode 12, together with ploc layer 25, may extend upwardly along the bow 24 to a point near the waterline 26. This alternate configuration is shown by broken lines 27 and 28 in FIG. 3.

Figure 4:
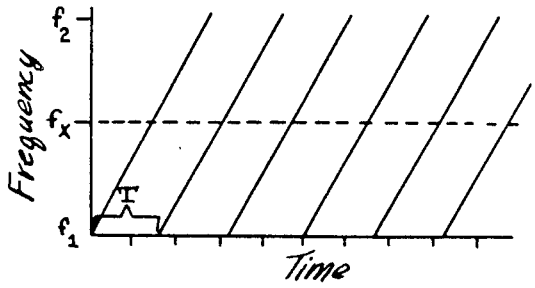
FIG. 4 is a diagrammatic showing of the time variation of the driving signal used by the invention.

The electrical signal supplied by the signal generating apparatus 15 is a time varying signal, as shown diagrammatically at FIG. 4. As indicated, the output consists of a plurality of signals applied to the electrodes and swept through a band of frequencies, indicated as being between $f_1$ and $f_2$. The exact frequency band is chosen so as to be centered about a frequency $f_x$ corresponding to the magnetic influence of ship 11 on a torpedo traveling at some normal speed and passing transversely beneath ship 11. The frequency excursion, i.e., the range between frequency $f_1$ and $f_2$, is chosen so as to include the probable velocities and trajectories of enemy torpedoes. The signal from signal generating apparatus 15 is of relatively low magnitude, depending on the spacing between electrodes 12 and 13. For purposes of illustration, it may be considered to be approximately 500 volts, a value corresponding to that required for a medium size warship.

Figure 5:
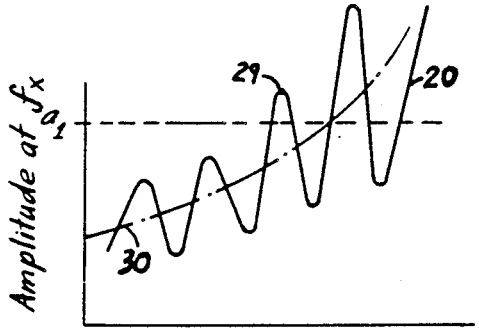
FIG. 5 is a diagrammatic illustration of the signal received by a torpedo approaching a ship using the system of the invention.

Referring to FIG. 5, there is shown by curve 20 the relative amplitude of the magnetic signal received by torpedo 17 as it approaches ship 11. The cyclical component of the received signal is caused by the transmitted signal sweeping through the passband of the torpedo 17's receiver. As torpedo 17 proceeds along its course and approaches ship 11, the average value of received magnetic signal is seen to increase as shown by line 30, but the cyclical nature of the electrical signal is also reflected as amplitude variations in the received magnetic signal. The proximity firing mechanism has a predetermined threshold of operation, indicated by $a_1$ in FIG. 5, and when this level is exceeded, as indicated by curve 20 crossing this value, the next cyclic variation in the received magnetic signal synthesizes the signal caused by passage of torpedo 17 beneath ship 11. This decrease in magnetic signal magnitude causes detonation of torpedo 17. This reversal point is shown at 29 on curve 20 and corresponds to point 22 in the trajectory shown in FIG. 2.

Signal generating apparatus 15 may comprise any state-of-the-art electronic apparatus providing the appropriate signal output as outlined above. The essential function is that the signal sweep through a range of frequencies that corresponds to the range of normal torpedo velocities and closing angles. Too, this range should be swept frequently to assure that a torpedo does not approach too close between sweeps. Practically, this requires the range of frequencies be swept simultaneous with a plurality of signal generators to assure that the proximity firing mechanism of the torpedoes is actuated. In developmental studies, two generators have been found sufficient and an exemplary arrangement thereof is diagrammatically shown in FIG. 6.

Figure 6:
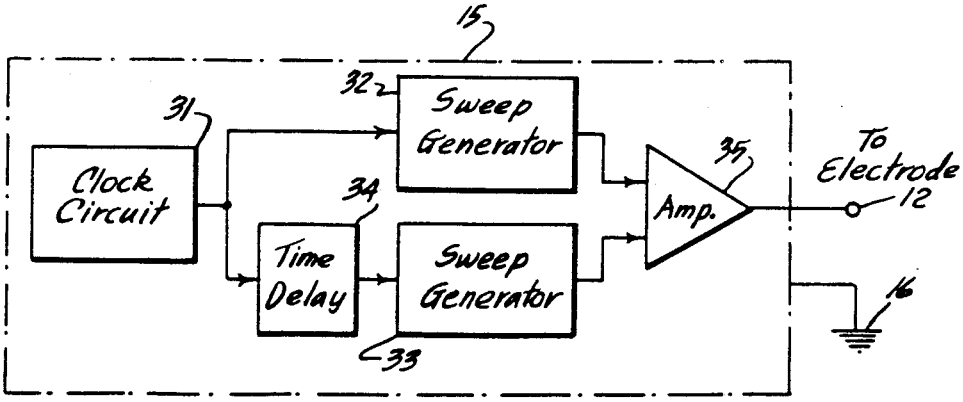
FIG. 6 is a diagrammatic showing of a signal source according to the invention.

Referring to FIG. 6, signal generating apparatus 15 is seen to comprise a clock circuit 31. A precise series of timing pulses is produced by clock circuit 31 and are used to regulate the sweep recurrence frequency of the generator 15. A variety of regulated frequency circuits are available to perform the required timing function and may be chosen for clock circuit 31 by the proficient electronics designer. The regulated output of clock circuit 31 triggers a first sweep generator 32 directly, and triggers a second sweep generator 33 through a time delay circuit 34.

Sweep generators 32 and 33 are identical and may be of any suitable type. Those sold under the tradename Wavetex and identified as model 111 have proven satisfactory, but other types may be employed if desired. Time delay 34 delays the output of sweep generator 33 for an interval, shown as T in FIG. 4, to provide an optimum return rate to the output of signal generator 15 at a frequency within the swept range. The outputs of sweep generators 32 and 33 are amplified to the proper voltage and power levels by a suitable amplifier 15.

From the foregoing it is apparent that the invention discloses an improved countermeasure system accomplishing objects of invention and uniquely effective against torpedoes equipped with magnetic proximity firing devices. The above description, taken together with the claims appended hereto, enable a person skilled in the torpedo countermeasure arts to make and use the invention which would have remained unobvious without the benefits thereof.

What is claimed is:

1. A torpedo countermeasure system for protecting a predetermined marine vehicle, having a metal hull the outside surface of which is painted, from torpedoes actuated by magnetic proximity firing means comprising:

first electrode means effectively mounted on substantially the forward end of said predetermined marine vehicle in such manner as to be in contact with the water in which said predetermined marine vehicle is located for establishing an electrically conducting contact therewith, said first electrode means having such a geometrical configuration as to enable it to extend around the front end of said predetermined marine vehicle at the waterline thereof, so as to thereby prevent removal of said paint by said water thereat;

means disposed between said predetermined marine vehicle and said first electrode means for the electrical insulation thereof therefrom;

second electrode means mounted on substantially the aft end of said predetermined marine vehicle in such manner as to be in electrical contact with the metal of the painted metal hull thereof and in contact with the water in which said predetermined marine vehicle is located for establishing electrically conducting contact therewith; and means electrically connected between the metal of the painted metal hull of said predetermined marine vehicle and the aforesaid first electrode means for generating and supplying a predetermined electrical signal thereto for effecting transmission thereof between said first and second electrode means via said water and through said predetermined marine vehicle via the painted metal hull thereof.

2. A torpedo countermeasure system according to claim 1 wherein said predetermined marine vehicle is a ship.

3. A torpedo countermeasure system according to claim 1 wherein said predetermined marine vehicle is a water subsurface vehicle.

4. A torpedo countermeasure system according to claim 1 wherein said predetermined marine vehicle is a water surface vehicle.

5. A torpedo countermeasure system according to claim 1 in which said electrical insulation means has a geometrical configuration which causes it to extend beyond the periphery of said first electrode means for improved electrical isolation therebetween and the aforesaid metal hull of said predetermined marine vehicle.

6. A torpedo countermeasure system according to claim 1 in which said insulation means is cementious ploc.

7. A torpedo countermeasure system according to claim 1 wherein the paint with which the outside surface of the hull of said predetermined marine vehicle is painted is an electrically insulating coating.

8. A torpedo countermeasure system for protecting a predetermined marine vehicle, having a metal hull the outside surface of which is painted, from torpedoes actuated by magnetic proximity firing means comprising:

first electrode means effectively mounted on substantially the forward end of said predetermined marine vehicle in such manner as to be in contact with the water in which said predetermined marine vehicle is located;

means disposed between said predetermined marine vehicle and said first electrode means for the electrical insulation thereof therefrom;

second electrode means mounted on substantially the aft end of said predetermined marine vehicle in such manner as to be in electrical contact with the metal of the painted metal hull thereof and for contact with the water in which said predetermined marine vehicle is located; and a plurality of electrical sweep generator means electrically connected between the metal of the painted metal hull of said predetermined marine vehicle and the aforesaid first electrode means for sweeping identical frequency bands in such manner as to produce a plurality of signals, each of which synthesizes in a narrow bandpass receiver the magnetic signal corresponding to said marine vehicle located at a predetermined range, and for effecting transmission thereof between said first and second electrode means via said water and through said predetermined marine vehicle via the painted metal hull thereof.

9. A torpedo countermeasure system according to claim 8 wherein said second electrode means comprises an unpainted section of the hull of said predetermined marine vehicle.

10. A torpedo countermeasure system according to claim 8 wherein said second electrode means comprises at least one propelling screw of said predetermined marine vehicle.

* * * * *